US005355115A

United States Patent [19]

Goor et al.

[11] Patent Number: 5,355,115

[45] Date of Patent: Oct. 11, 1994

[54] WAITSTAFF SIGNALING DEVICE FOR USE IN A SERVICE ESTABLISHMENT

[75] Inventors: Dan Goor; E. Patricia Goor; Robert P. Harnisch, all of Colorado Springs, Colo.

[73] Assignee: Goor Associates, Inc., Colorado Springs, Colo.

[21] Appl. No.: 989,831

[22] Filed: Dec. 14, 1992

[51] Int. Cl.[5] ..... G08B 5/00

[52] U.S. Cl. ..... 340/321; 340/286.09; 362/154; 362/155

[58] Field of Search ..... 116/DIG. 1, 2, 200, 116/201, 202, 313, 309, 306, 305; 340/286.09, 321, 568, 323, 324, 359; 364/705.06, 708.1; 362/98, 99, 154, 155

[56] References Cited

U.S. PATENT DOCUMENTS

| | | | |
|---|---|---|---|
| 2,563,693 | 8/1951 | Russell | 362/154 |
| 2,565,980 | 8/1951 | Moore | 362/154 |
| 2,659,486 | 11/1953 | Krupin | 40/323 |
| 3,558,871 | 1/1971 | Rogers | 240/13 |
| 3,810,164 | 5/1974 | Lambert | 340/332 |
| 3,821,707 | 6/1974 | Peters | 340/171 R |
| 3,967,274 | 6/1976 | Howell | 340/380 |
| 4,222,111 | 9/1980 | Sloan et al. | 364/900 |
| 4,250,491 | 2/1981 | Dotson | 340/321 |
| 4,530,067 | 7/1985 | Dorr | 364/900 |
| 4,701,849 | 10/1987 | Elden | 364/401 |
| 4,777,488 | 10/1988 | Carlman, Jr. et al. | 340/825.72 |
| 5,016,262 | 5/1991 | Cushing | 377/15 |

FOREIGN PATENT DOCUMENTS

| | | | |
|---|---|---|---|
| 657246 | 1/1929 | France | 40/323 |
| 480194 | 2/1938 | United Kingdom | 362/154 |

*Primary Examiner*—James J. Groody
*Assistant Examiner*—Nathan J. Flynn
*Attorney, Agent, or Firm*—Weingarten, Schurgin, Gagnebin & Hayes

[57] ABSTRACT

The invention provides a payment folder having a signal device for communicating to a server a patron's readiness and urgency to pay a service establishment's bill. In one embodiment, the signal device includes at least one battery powered light, such as a light emitting diode, mounted on the payment folder so as to be visible to an observer. The light(s) are illuminated in one or more colors and may be caused to blink in response to appropriate positioning of a control switch that can include a control circuit. In other embodiments, the signal device is a manually positionable colored surface, such as a flag, attached to the payment folder. Signaling is accomplished by withdrawing the colored surface from within the payment folder or by positioning the colored surface so that it is visible through an opening in or a transparent portion of the payment folder.

7 Claims, 2 Drawing Sheets

WAITSTAFF SIGNALING DEVICE FOR USE IN A SERVICE ESTABLISHMENT

FIELD OF THE INVENTION

This invention relates to a payment folder, and more particularly a payment folder incorporating a signal device.

BACKGROUND OF THE INVENTION

An ongoing issue at service establishments such as restaurants, bars and the like is the difficulty patrons have communicating to someone on the waitstaff their readiness to pay their bill so that they may depart from the restaurant at their convenience. This is especially problematic in establishments with high customer to server ratios. Not infrequently a patron must devote considerable time and effort to making eye contact with or hailing someone on the waitstaff to collect payment. This problem is compounded by the inherent features of payment folders which have the same appearance whether or not payment is enclosed therein. Even an attentive server is forced to guess whether the bill is ready for settlement or to inquire repeatedly. In addition to the difficulty patrons have in signaling their readiness for payment, is their inability to signal the appropriate sense of urgency requested. All of these factors lead to customer frustration and dissatisfaction, as well as reduced server efficiency.

Devices to signal servers in restaurants and bars are not unknown, and fall into two general categories. One category of signaling devices includes lamps placed on each patron's table and which are illuminated or modified when service is desired. Examples of these devices are described in U.S. Pat. Nos. 4,250,491 to Dotson; 3,967,274 to Howell; and 3,558,871 to Rogers. One disadvantage of table lamps is their relatively high unit cost which must be multiplied by the number of tables in the restaurant or lounge. For a large establishment this represents a considerable investment.

The other category of signaling devices is a permanently installed system that includes signal buttons at each table or seat and a single signal panel or control unit. Systems of this type are detailed in U.S. Pat. Nos. 4,777,488 to Carlman, Jr. et al.; 4,222,111 to Sloan et al.; 3,821,707 to Peters; and 3,810,164 to Lambert. These systems share the "one for each table" cost penalty of the table lamps, and incur additional cost penalties associated with complex permanent wiring and installation. Furthermore, these systems must be customized and do not lend themselves to relatively inexpensive, off-the-shelf sales by restaurant suppliers. Accordingly, these complex systems are not widely used.

An inexpensive, non-permanent signaling device for communicating with a server could find wide application by restaurant owners striving to improve customer satisfaction. Unfortunately, such a device does not presently exist.

SUMMARY OF THE INVENTION

The present invention overcomes the disadvantages of the prior art by providing a bill payment folder incorporating a signal device. The folder is easy to use, inexpensive, and portable. In a first embodiment, the payment folder includes two connected covers that serve to conceal a payment or a bill held therebetween and a signal device. The signal device can include one or more battery powered electric lights or a manually positioned colored surface, either of which is positioned on the payment folder, or positionable so as to be visible to an observer when the payment folder is placed on a table.

In a second embodiment the payment folder includes a first light mounted on a cover of the payment folder, a battery, and a switch. The payment folder can include a second light that can be illuminated in a different color than the first light and a control circuit for controlling an illumination color and pattern.

BRIEF DESCRIPTION OF THE DRAWINGS

These and further features of the invention may be better understood with reference to the accompanying specification and the drawings in which.

DETAILED DESCRIPTION OF THE INVENTION

Figure 1:
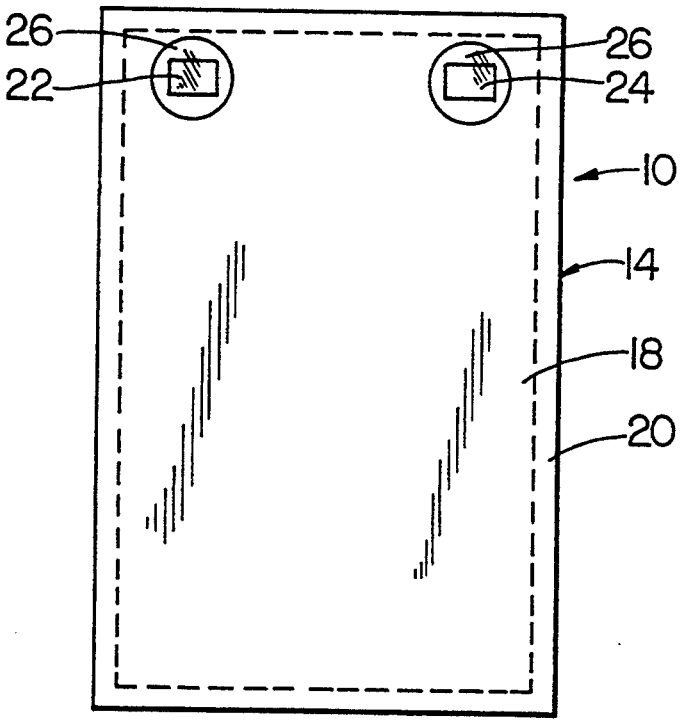
FIG. 1 is a front plan view of a payment folder of the invention having signal lights.

Payment folders having a signaling device in accordance with the invention are divided into either electrical or mechanical embodiments. FIG. 1 is an illustration of an exemplary embodiment of a payment folder 10 that incorporates electrically powered signaling devices. The front cover 14 of the payment folder 10, as well as the back cover 16 (shown in FIG. 2) includes a cardboard stiffener 18 covered by a layer of vinyl 20. Mounted in or on the cardboard stiffener 18, are signaling devices, such as a first and a second signal light, 22 and 24 respectively. The signal lights 22, 24 protrude through the layer of vinyl 20 or are visible through a transparent or translucent window in the layer of vinyl 20 so as to be easily observable from a distance when illuminated. The signal lights 22, 24 are incandescent bulbs or light emitting diodes (LEDs) that are the same or different colors and illuminated steadily or flashing.

In the embodiment of FIG. 1, the signal lights 22, 24 are positioned so as to be visible to a person looking toward the payment folder 10 when it is placed on a table face-up. To protect the bulb or LED, to provide colored light, or to enhance visibility of the signal lights 22, 24, each can be covered with a clear or colored light diffusion lens 26. Multiple, clustered LEDs or bulbs can also be used to enhance visibility of the signal lights 22, 24.

Figure 2:
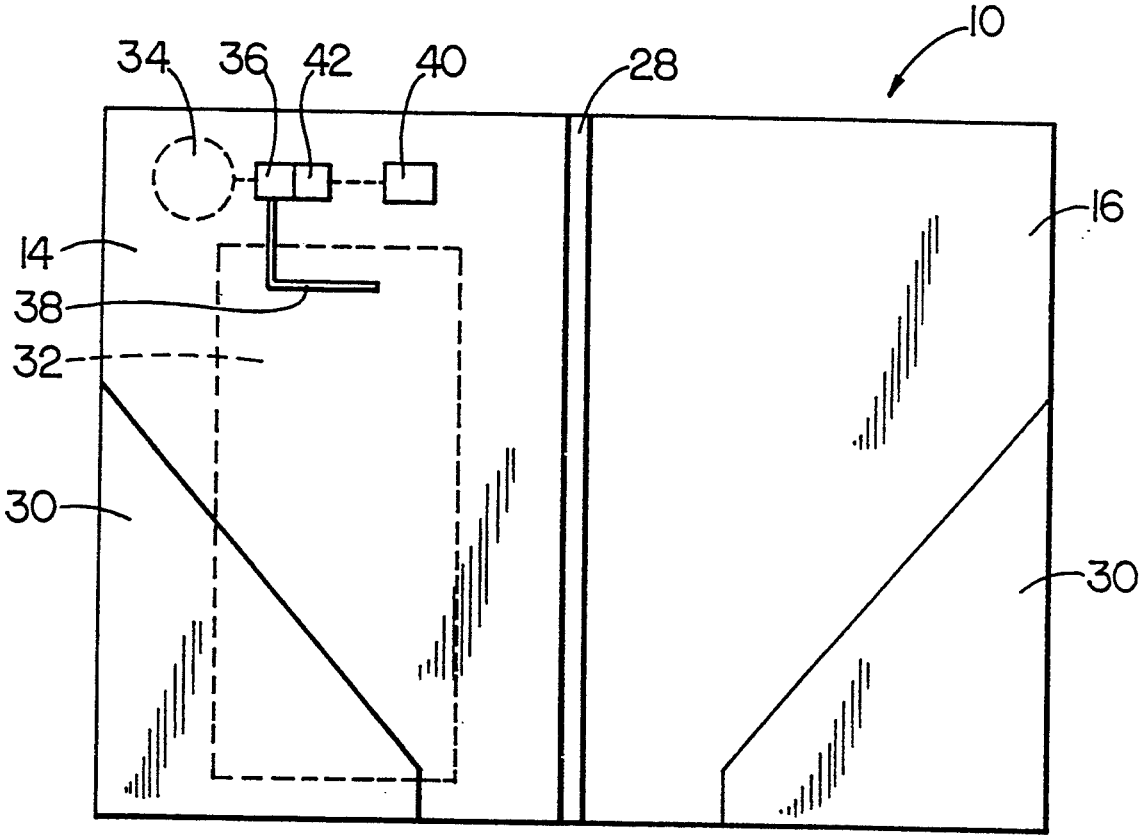
FIG. 2 is a plan view of the interior of the unfolded payment folder of FIG. 1, illustrating light activation apparatus.

FIG. 2 is an illustration of the payment folder 10 in its unfolded state wherein a pliant fold or hinge 28 provides a connection between the front and rear covers, 14 and 16 respectively. Each of the covers 14, 16 is provided with optional pockets 30 for retaining a bill or payment medium 32 such as paper currency, a check, a credit card and the like. Both of the covers 14,16 also serve as a convenient location onto which instructions for communicating with a server via the signaling devices of the payment folder 10 may be printed or affixed.

A power source, such as a 3 volt battery 34, is embedded in or mounted on the cardboard stiffener 18 and is connected to both of the signal lights 22, 24 in circuit with a switch 36 for turning the light on and off. The switch 36 can be any type well known in the art such as a simple sliding switch, or a push to activate membrane switch, and may have an extension 38 which functions both to retain the payment medium 32 and activate the signaling device when lifted to place the payment medium 32 thereunder. The switch 36 is optionally connected to a multiple position urgency control 40, whereby a patron can select a "normal" or "urgent" setting, for example, to signal to the server the patron's readiness to pay. An optional control circuit 42, such as a simple microprocessor or chip, is responsive to the patron's positioning of the urgency control 40 and commands a preprogrammed illumination sequence of the signal lights 22, 24.

In one embodiment, the position of the urgency control 40 in conjunction with the wiring or logic of the control circuit 42 causes the first signal light 22 to illuminate green when "normal" is selected and the second signal light 24 to illuminate red when "urgent" is selected. The control circuit 42 can be preprogrammed to allow a signal light to remain illuminated for a determinable length of time, after which the signal light can be caused to change color or flash as appropriate to indicate to a server the length of time a patron has been waiting for someone on the waitstaff to look toward the patron's table.

Figure 3:
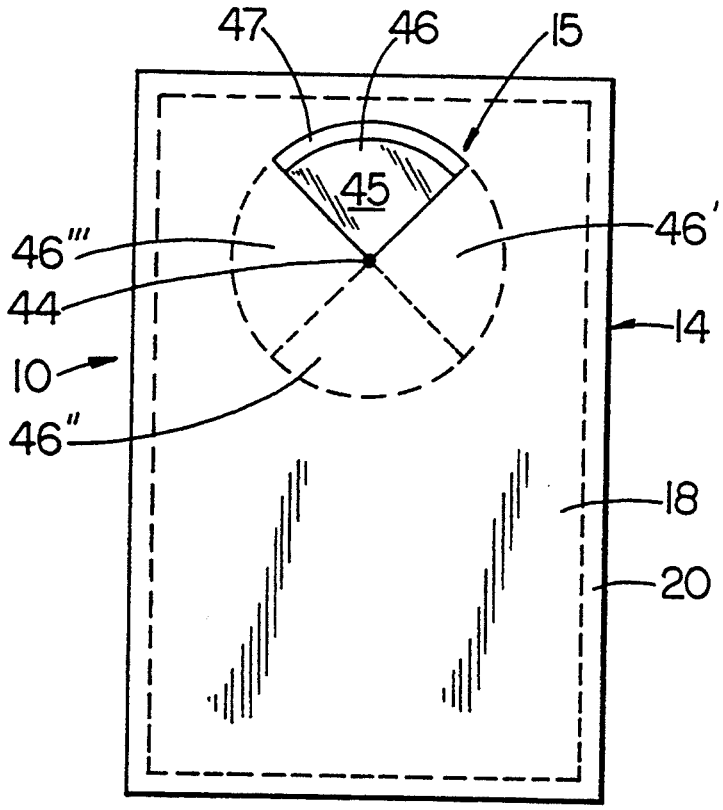
FIG. 3 is an alternative embodiment of the payment folder of the invention, having a colored signal flag.

Other embodiments of the payment folder 10 substitute manually positionable signaling means for the lights and electronic circuitry utilized in the embodiment of FIG. 1. FIG. 3 shows the front cover 14 of payment folder 10 wherein the signal device is a colored disk 15 attached to the cardboard stiffener 18 by a pin 44 about which the disk is free to rotate. The layer of vinyl 20 covering the cardboard stiffener 18 also covers the disk 15 except for a cut-out or translucent window 45 through which a portion of the disk 15 may be visible. Part of the disk 15, such as its outer edge 47, is accessible from the exterior of the front cover 14 to permit the disk 15 to be rotated.

The disk 15 can be divided into two or more sectors, only one of which being visible at a time through the window 45, that represent at least a first state indicating readiness to pay and a second state indicating non-readiness to pay. In the embodiment of FIG. 3, the disk 15 includes sectors 46, 46', 46'', and 46''' that are color coded black, green, yellow, and red respectively. Thus, to communicate readiness to pay a server, a patron manually selects a color coded sector in accordance with the provided instructions by rotating the outer edge 47 of the disk 15 until the appropriate sector 46, 46', 46'', or 46''' is visible through the window 45. The patron then places the payment folder 10 on the table in a face-up position and waits for a response from a server.

Figure 4:
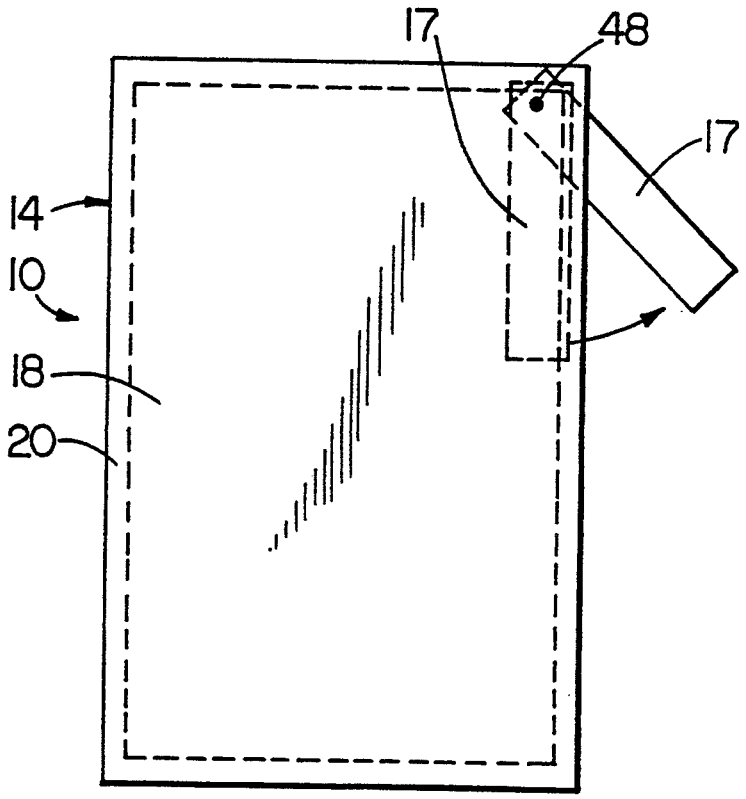
FIG. 4 illustrates an alternative embodiment of the signal device of FIG. 3.

FIG. 4 illustrates an alternative embodiment of the payment folder 10 having a manually positionable signaling means. In this embodiment the signal device includes one or more flags 17 attached to the front cover 14 with a pin 48. The flags are free to rotate from a first position within or hidden by the front cover 14 to a second position visible from the exterior of the payment folder 10, as indicated by the arrow in FIG. 4. Thus, to communicate the appropriate sense of urgency to a server, a patron exposes all or part of the flag 17, or the appropriate color flag 17 if there are more than one, and places the payment folder 10 on the table. The embodiment of FIG. 4 is especially usefully as an aftermarket device, wherein the pin 48 with the signal device attached thereto is easily secured to a preexisting payment folder with a simple hand tool.

All of the embodiments are superior signaling devices for several reasons. First, all of the payment folders are manufactured at a only slightly greater cost than ordinary payment folders. Second, because bill payment folders are only distributed to a small portion of patrons at a given time, a smaller number of folders than tables are needed. Third, due to the portable nature of the payment folders, no permanent modification of the service establishment or tables is necessary. Fourth, because of the low cost and nonpermanent nature of payment folder with a signal light, an establishment can experiment with server signaling on a low-cost trial basis.

Although the invention has been shown and described with respect to exemplary embodiments thereof, various other changes, omissions and additions in form and detail thereof may be made therein without departing from the spirit and scope of the invention.

We claim:

1. A waitstaff signaling device comprising:

a bill payment folder including, a first cover having a first side and a second side, and a second cover having a first side and a second side, said second cover movably secured to said first cover;

a signal device cooperative with one of said covers, said signal device having a first state and a second state;

a switch in communication with said signal device for switching said signal device from said first state to said second state; and a clip connected to said switch so that opening or closing said clip actuates said switch and thereby activates said signal device.

2. The waitstaff signaling device of claim 1, wherein said signal device includes an electric light.

3. The waitstaff signaling device of claim 1, wherein said signal device is an incandescent bulb.

4. The waitstaff signaling device of claim 1, wherein said signal device is a light emitting diode.

5. The waitstaff signaling device of claim 1, wherein said signal device is covered by a diffusion lens.

6. The waitstaff signaling device of claim 2, further comprising a second light controlled by said switch.

7. The waitstaff signaling device of claim 6, wherein said first light and said second light are illuminated in different colors.

* * * * *